US005356456A

United States Patent [19]

Nishikawa et al.

[11] Patent Number: 5,356,456

[45] Date of Patent: Oct. 18, 1994

[54] METHOD OF DEGASSING AND DECARBURIZING STAINLESS MOLTEN STEEL

[75] Inventors: Hiroshi Nishikawa; Masanori Nishikohri; Hitoshi Ohsugi, all of Chiba, Japan

[73] Assignee: Kawasaki Steel Corporation, Japan

[21] Appl. No.: 131,894

[22] Filed: Oct. 5, 1993

[30] Foreign Application Priority Data

Oct. 7, 1992 [JP] Japan ..... 4-268653
Jun. 11, 1993 [JP] Japan ..... 5-140824

[51] Int. Cl.[5] ..... C21C 7/10
[52] U.S. Cl. ..... 75/508; 75/711
[58] Field of Search ..... 75/711, 508

[56] References Cited

U.S. PATENT DOCUMENTS 4,104,057 8/1978 Maas ..... 75/511
4,979,983 12/1990 Nishikawa ..... 75/511

*Primary Examiner*—Peter D. Rosenberg
*Attorney, Agent, or Firm*—Austin R. Miller

[57] ABSTRACT

A method of degassing and decarburizing molten stainless steel in a vacuum, which molten steel is produced in a steel making furnace. Molten steel is foamed in a vacuum tank. Before foaming the [N] (%) in the molten steel is increased. The foam is produced by denitrification of the steel during vacuum degassing. Oxidizing gas is blown through a top-blow lance onto the surface of the steel in a vacuum tank, causing the reaction $C+\frac{1}{2}O_2 \rightarrow CO$ to decarbonize the steel. Temperature decrease of the molten steel is resisted by combustion of CO produced by the reaction of $C+\frac{1}{2}O_2 \rightarrow CO$.

19 Claims, 4 Drawing Sheets

METHOD OF DEGASSING AND DECARBURIZING STAINLESS MOLTEN STEEL

BACKGROUND OF THE INVENTION

1. Field of the Invention

The present invention relates to vacuum decarburization and degassing of molten stainless steel. More particularly, the invention relates to a method of degassing and decarburizing the stainless steel while oxygen is being blown onto a steel bath surface in a vacuum. Decarburization is efficiently performed while minimizing oxidation of Cr in the steel bath and, at the same time, providing decrease of the temperature of the molten steel to obtain a low oxygen content.

2. Description of the Related Art

It has been disclosed to perform vacuum decarburization in a molten bath in making high-Cr steel or the like, in which oxygen gas is blown from the side wall of a container into a relatively shallow position in the steel bath below the molten bath surface. This has been disclosed in Japanese Patent Unexamined Publication No. 51-140815. Also, Japanese Patent Unexamined Publication No. 55-2759 discloses a method of making extremely low-carbon stainless steel in which inert gas is supplied in the presence of slag.

Although it is possible for these methods to promote decarburization, the problem of preventing a decrease of the temperature of the molten steel, which is a problem during decarburization, has not heretofore been taken into consideration.

In the refining of stainless steel, the concept of suppressing oxidation of Cr by controlling the carbon content of the steel at 0.15 wt % before it is subjected to vacuum decarburization has been disclosed. However, decarburization is the main object of even this method. No mention is made suggesting the idea of preventing decrease of the temperature of the molten steel, and the problem of suppressing oxidation of Cr during vacuum decarburization is not described.

Disclosed in Japanese Patent Unexamined Publication No. 2-77518 is a method for preventing a decrease of the temperature of molten steel by blowing oxygen from a top-blow lance in order to cause secondary combustion during vacuum decarburization. However, this method is mainly concerned with technology for plain steel not containing Cr. The method of Japanese Patent Laid-Open Publication No. 2-77518 is not suited to refine stainless steel because of the following reasons.

Since Cr in molten steel is very easily oxidized by oxygen, it is very disadvantageous to directly use the top-blow oxygen method commonly used for refining plain steel to refine stainless steel. If the top-blow oxygen method commonly used for refining plain steel is directly used to refine stainless steel, oxidation of Cr progresses, and costs rise due to loss of Cr, and the molten steel is contaminated by the generated oxidized Cr.

SUMMARY OF THE INVENTION

Accordingly, it is an object of the present invention to create a method of degassing and decarburizing molten stainless molten steel, which method is capable of promoting a decarburization reaction during degassing and decarburization in a vacuum while advantageously preventing Cr from being oxidized and while still preventing the temperature of the molten steel from decreasing.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

Figure 1:
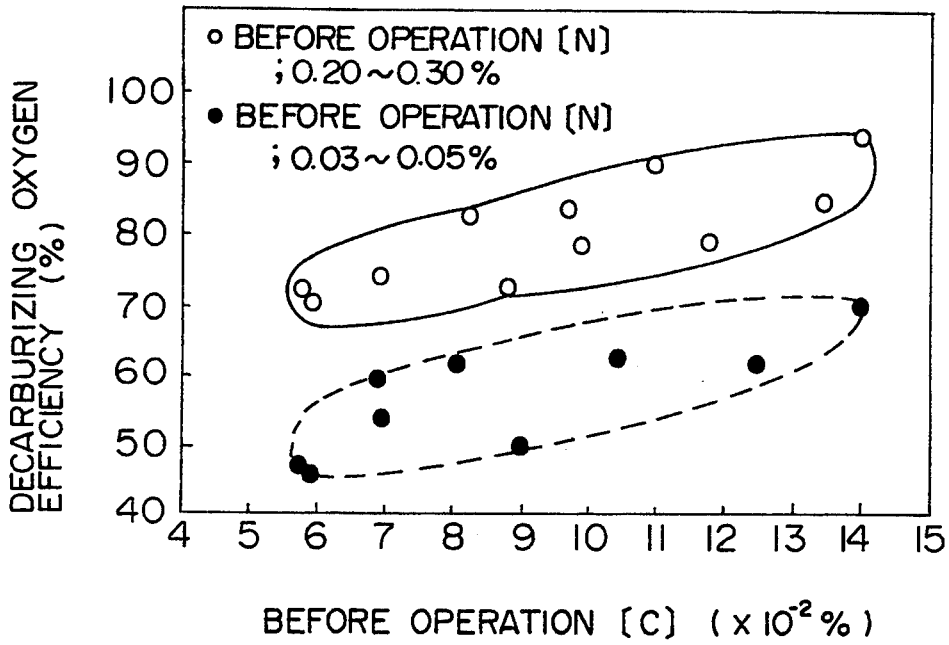
FIG. 1 is a graph illustrating influences of the [C] (%) before beginning the operation and the [N] (%) before the beginning operation, upon the decarburizing oxygen efficiency.

The present invention pertains to a method of degassing and decarburizing molten stainless steel in a vacuum. The percentage of [N] in the molten steel is adjusted in advance to a particularly high value, preferably about 0.20 to 0.30%, after which the molten steel bath is subjected to foaming in a vacuum. A denitrification reaction is induced and the molten steel is subjected to degassing. Oxidizing gas is blown onto the steel bath surface in the vacuum tank, causing the decarburization reaction $$C+\tfrac{1}{2}O_2 \rightarrow CO$$

to take place in order to achieve decarburization. This invention overcomes the problem of decreasing the temperature of the molten steel while the decarburization reaction is taking place.

In the description of this invention all percentages are by weight unless otherwise indicated.

According to a preferred embodiment of the invention degassing and decarburizing of stainless molten steel are performed in a vacuum furnace by adjusting the initial content of [N(%)] divided by the initial content of [Cr(%)] in the molten steel to about $3.0\times10^{-3}$, and blowing an oxidizing gas at a controlled rate onto the surface of the molten steel through a top-blow lance having a nozzle and a throat in a vacuum degassing container. Several important parameters are carefully controlled to achieve an important value of $\alpha$, which is the common logarithm of the pressure existing at the center of the blown oxidizing gas at the molten steel surface. It is important to control the process so that $\alpha$ is in the range from about $-1$ to 4, $\alpha$ being defined by the following equation (1):

$$\alpha = -0.808(LH)^{0.7} + 0.00191(PV) + 0.00388(S_o/S_s)Q + 2.97 \quad (1)$$

where LH is the height in meters from the stationary bath surface of the molten steel to the tip of the top-blow lance in the vacuum a degassing tank, PV is the degree of vacuum (Tort) in the vacuum degassing tank after the oxidizing gas has been supplied, $S_o$ is the area in square millimeters of the nozzle outlet portion of the top-blow lance, $S_s$ is the area in square millimeters of the nozzle throat of the top-blow lance, and Q is the rate of flow ($Nm^3$/min.) of the oxygen or oxidizing gas.

According to another important embodiment of the present invention, vacuum degassing and decarburizing of molten stainless steel produced in a steel furnace is achieved by adjusting the sum of the [C] % and the [N] % in the molten steel to about 0.14 wt. % before the operation starts, and blowing oxidizing gas onto the surface of the molten steel in a vacuum degassing tank, preferably through a top-blow lance having a nozzle and a throat, and controlling the rate of blowing so that the value of $\alpha$ is in the range from about $-1$ to 4, $\alpha$ being defined by the same equation (1).

The oxidizing gas utilized may be oxygen gas or an oxygen-containing gas. In the aforementioned equation (1), the rate of flow Q of oxygen gas when an oxygen-containing gas is used, is calculated in accordance with the amount of oxygen contained. For the top-blow lance, a Laval type lance is advantageously applicable. When the nozzle of the lance is straight, Ss=So.

An important feature of the present invention is the fact that degassing and decarburization are performed in a vacuum, causing foaming of the molten steel in the vacuum tank, in conjunction with the step of controlling the weight percentage [N] (%) in the molten steel to a high value such as about 0.20–0.30% beforehand, thereby inducing denitrification during the vacuum degassing operation. This is accompanied by blowing oxidizing gas through a top-blow lance onto the foamed steel bath surface in the vacuum tank, causing the reaction $C + \frac{1}{2}O_2 \rightarrow CO$ to take place to achieve decarburization, thereby preventing or minimizing temperature decrease of the molten steel by combustion of the CO gas produced concurrently with decarburization.

It is important in the practice of the present invention that some of the oxidizing gas to be supplied from a top-blow lance is supplied while suppressing oxidation of Cr. More specifically, if all the available oxygen is used for decarburization, it becomes difficult to apply heat to the molten steel. To promote the application of heat to the molten steel, it has been found necessary to control the pressure at which the oxidizing gas reaches the molten-steel surface. This may be done by controlling the conditions of the vacuum degassing operation. The height of the lance tip above the stationary bath surface is important. Also important are the degree of vacuum in the vacuum tank, the rate of flow of the oxidizing gas and the shape of the lance. Maintaining the proper oxidizing gas pressure makes it possible to burn the decarburization CO gas in the proximity of the molten-steel surface. This surprisingly achieves suppression of Cr oxidation and promotes decarburization, thereby efficiently applying heat to the molten steel surface.

We have described in Japanese Patent Unexamined Publication No. 2-77518 the pressure at which the above-mentioned oxidizing gas jets reach the molten-steel surface. As the pressure attained, as defined in this Publication, is used also in the present invention, this attained pressure will be explained in more detail hereinafter.

When oxidizing gas is blown into the vacuum tank during the vacuum degassing and decarburizing operation, it is generally necessary to control various complex conditions, including the height at which the oxidizing gas is supplied, the degree of vacuum, the shape of the lance used, and the rate of flow of the oxidizing gas. If any one of these conditions varies, the net effect varies greatly. We have determined the effects due to changes of these conditions on the basis of the pressure P (Tort) at which the central axis of the blown oxidizing gas (the central axis of the lance) reaches the molten steel surface. If this pressure is represented as $\log_{10}P$ and if this is abbreviated as $\alpha$, $\alpha$ has been determined to be defined approximately by the equation heretofore set forth:

$$\alpha = -0.808(LH)^{0.7} + 0.00191(PV) + 0.00388(S_o/S_s)Q + 2.97 \quad (1)$$

where LH is the height (m) of the lance, PV is the degree of vacuum (Tort) in the vacuum degassing tank after oxidizing gas has been supplied, $S_o$ is the area ($mm^2$) of the nozzle outlet portion of the top-blow lance, $S_s$ is the area ($mm^2$) of the nozzle throat of the top-blow lance, and Q is the rate of flow ($Nm^3$/min.) of oxygen gas.

Using equation (1) the applicable pressure can be determined for use of various nozzles, including Laval nozzles and straight nozzles having various outlet diameters and throat diameters.

Since the blowing of oxygen or oxidizing gas onto the molten steel causes Cr oxidation at the same time as decarburization, it is necessary to cause secondary combustion while minimizing Cr oxidation. Because of this, it is important to blow the oxygen directly on the surface of the molten steel with low CO pressure in a vacuum. However, the oxygen should not be caused to penetrate deeply into the molten steel. Accordingly, it is highly advantageous to foam the molten steel surface in the vacuum tank. This can be realized by incorporating [N] in the molten steel so as to cause denitrification that leads to foaming. Further, since a temperature decrease of the molten steel due to secondary combustion is prevented, decarburization is promoted.

Differences between the above-mentioned Japanese Patent Laid-Open Publication No. 2-77518 and the present invention will now be explained.

As described above, the invention of Japanese Patent Laid-Open Publication No. 2-77518 pertains to refining plain steel, whereas the present invention pertains to refining stainless steel. Stainless molten steel having a large Cr content has high N solubility. This molten steel having increased solubility causes a phenomenon of foaming in a vacuum due to de-N.

The present invention uses this foaming phenomenon, as described above. In contrast, plain steel used for Japanese Patent Laid-Open Publication No. 2-77518 has lower N solubility than stainless molten steel, and does not cause a foaming phenomenon.

One important embodiment of the present invention will now be explained, with reference to an example we have carried out.

FIG. 1 illustrates the relationship between the decarburization oxygen efficiency and the [C] (%) before an RH degassing operation when oxygen is blown from the top-blow lance and wherein decarburization is performed using 100 tons of SUS 304 molten steel, subjected to an RH vacuum degassing operation.

In this example, the IN] (%) before the RH degassing operation was, at the stage of converter refining, either:

(1) [N] was adjusted to 0.20 to 0.30% by using $N_2$ as a dilution gas and a reduction gas, or (2) [N] was adjusted to 0.03 to 0.05% by using Ar as a dilution gas and a reduction gas.

The conditions for the RH vacuum degassing operation at that time were: temperature before the operation: 1,630° to 1,640° C., LH: 4.0 m, degree of vacuum PV: 8 to 12 Torr, lance shape $S_o/S_s$: 2.5, rate of flow Q of oxygen gas: 10 $Nm^3$/min., total oxygen source unit: 0.6 to 1,3 $Nm^3$/t, and the [C] content before the operation of 0.10 to 0.14% was adjusted to 0.03 to 0.04%.

The results of this example show that higher decarburization oxygen efficiency can be obtained when the content of [N] before the operation is adjusted to about 0.20 to 0.30% than when the content of [N] before the operation is 0.03 to 0.05%. When the inside of the RH vacuum degassing tank was observed, foaming of the molten steel was observed during decarburization when the [N]% was about 0.20 to 0.30%, whereas foaming was not observed though a small amount of splashing was noted when the IN]% before the operation was 0.3 to 0.5%.

We have further investigated the relationship between the amount of Cr oxidized and the [N] %/[Cr] % ratio as it existed before vacuum degassing before beginning the RH vacuum degassing was performed on SUS 304 and SUS 430 molten steels, the amount of each steel being 100 tons. The Al content of each of the molten steels was 0.002% or less.

Figure 2:
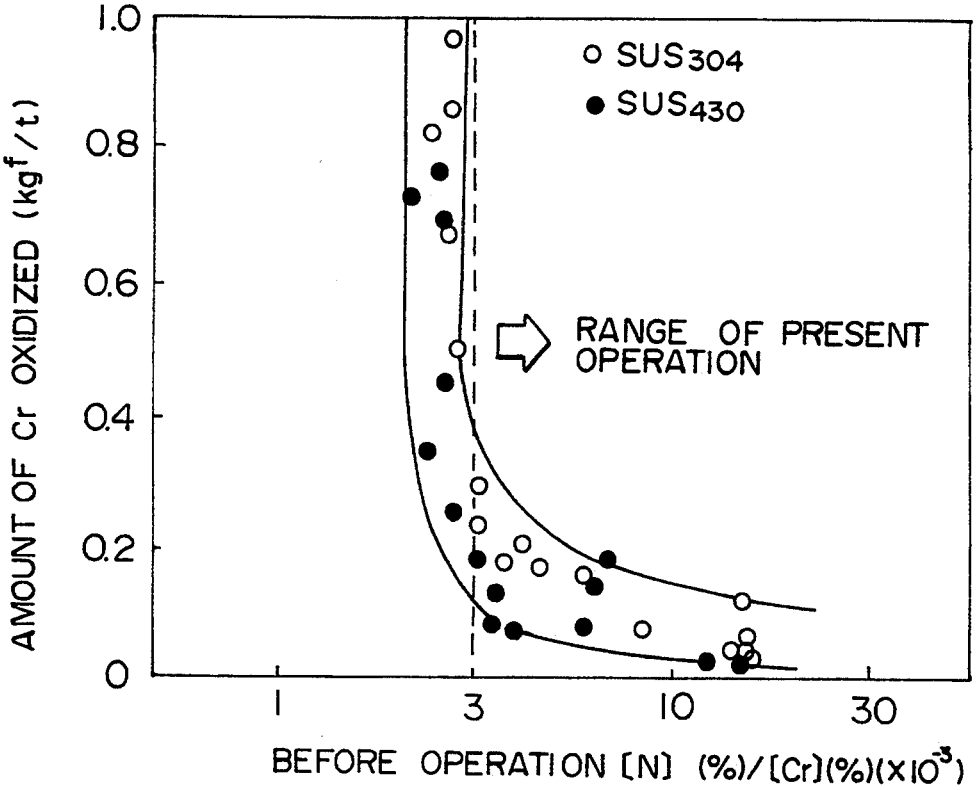
FIG. 2 is a graph illustrating the relationship between the amount of Cr oxidized and the ratio of [N] (%)/[C] (%) before beginning the decarburization operation.

FIG. 2 shows the results of this example. The conditions for the RH vacuum degassing operation were the same as described above. The [C] content before the operation was 0.10 to 0.14%, and the [C] content after the operation was 0.04 to 0.05%. The results of this example reveal that Cr oxidation is suppressed in a region in which the ratio of [N] %/[Cr] % before the RH vacuum degassing operation is about $3.0\times10^{-3}$ or more. It was also revealed that the foaming of the molten steel in the RH vacuum degassing tank occurred in the region where the ratio [N] %/[Cr] %, as it existed before beginning the RH vacuum degassing operation, was $3.0\times10^{-3}$ or more. The amount of Cr oxidized is a value (kgf/t) in which the Cr density taken when the blowing of the oxidizing gas is terminated, is subtracted from the Cr density as it existed before beginning the vacuum degassing and decarburization operation. In the present invention, based on the above, the optimum ratio [N] %/[Cr] % before beginning the decarburization operation was determined to be $3.0\times10^{-3}$ or more.

Factors causing foaming of molten steel may include [H] in addition to [N]. However, it is difficult to add [H] to the steel at such a high density that foaming occurs. Even if some [H] can be added, the degassing rate of [H] is significantly higher than that of [N]; therefore the necessary foaming time necessary for blowing oxygen cannot be sustained. On the basis of this, [N] is preferred as the added component for causing the foaming of molten steel.

Figure 3:
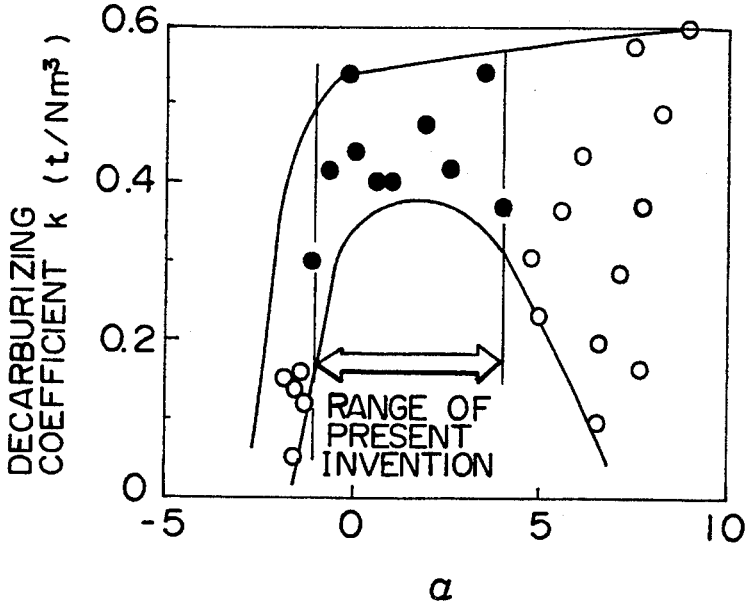
FIG. 3 is a graph illustrating the relationship between the decarburization coefficient and the pressure $\alpha$ at which oxidizing gas contacts the molten-steel surface.
Figure 4:
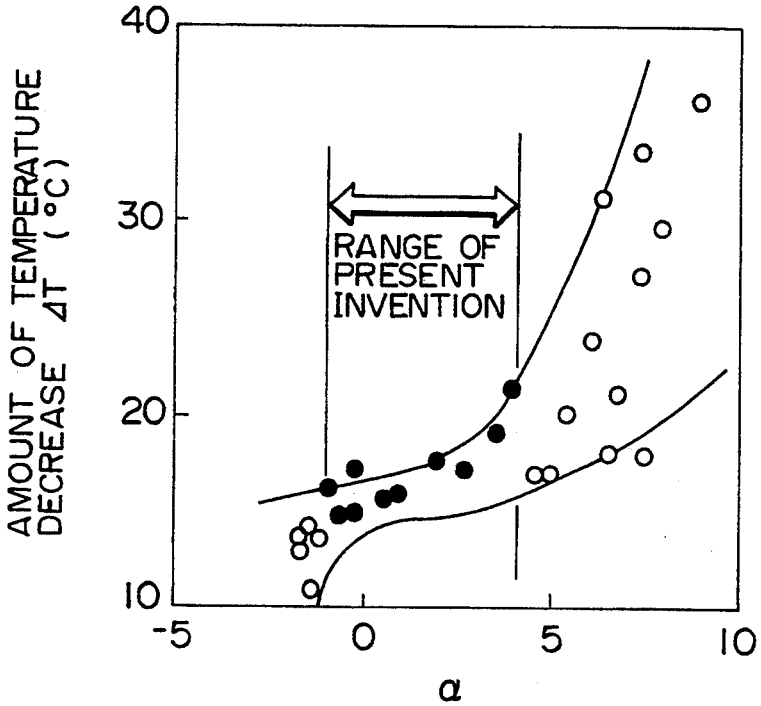
FIG. 4 is a graph illustrating the relationship between the amount AT of the temperature decrease of the molten steel and the pressure $\Delta T$ at which oxidizing gas contacts the molten-steel surface.

Turning now to the blowing of oxygen in the vacuum degassing tank, it will be recalled that the oxygen must be blown onto foaming molten steel according to this invention. When blowing is too strong (hard blow), oxygen directly penetrates too deeply into the molten steel and causes unwanted oxidation. It is then also difficult for secondary combustion to occur. Further, Cr loss is increased. In contrast, when blowing is too weak (soft blow), secondary combustion is promoted but decarburization is impeded. Therefore, oxygen blowing must be critically controlled. Thus, the decarburization behavior of stainless molten steel and avoidance of temperature decrease of the molten stainless steel were determined by using the heretofore-described equation (1) regarding the pressure at which the oxygen or oxygen-containing gas contacts the molten steel surface during the blowing of oxygen in a vacuum. The results of the determination are shown in FIGS. 3 and 4.

Steel of the SUS 304 type was used. The percentage of [C] before beginning the RH vacuum degassing operation was set at 0.11 to 0.14%. The percentage of [C] after the RH vacuum degassing operation was 0.03 to 0.04%. The percentage of [N] before beginning the RH vacuum degassing operation was 0.15 to 0.20%. The conditions for the operation were LH: 1 to 12 m, PV: 0.3 to 100 Tort, $S_o/S_s$: 1 to 46, and Q: 5 to 60 $Nm^3$/min. The temperature before starting the decarburization operation was 1,630° to 1,640° C.

The decarburization behavior was controlled in accord with a decarburization coefficient defined by the following equation (2):

$$[C]_s/[C]=kQ(O_2) \quad (2)$$

where $[C]_s$ is the [C] % before the RH operation, [C] is [C] % when the blowing of oxidizing gas is terminated in the RH operation, k is the decarburization coefficient (t/$Nm^3$), and $Q(O_2)$ is the amount of oxygen ($Nm^3$/t). Further, temperature decrease is defined by the following equation (3):

$$\Delta T=T_sT \quad (3)$$

where $T_s$ is the temperature (°C.) of the molten steel when the RH operation starts, and T is the temperature (°C.) of the molten steel when oxygen blowing is terminated.

It can be seen from FIGS. 3 and 4 that the preferred range of the value $\alpha$ (the logarithm of the pressure) at which oxygen reaches the molten steel surface, which range achieves both the decarburization coefficient and the resistance to temperature decrease, is from about −1 to 4. More specifically, if $\alpha$ exceeds 4, both the decarburization coefficient and the temperature decrease vary greatly, causing the decarburization rate to decrease. This is due to the fact that Cr is oxidized with the decarburization and Cr oxidation impedes the decarburization. If, in contrast, $\alpha$ is less than −1, the temperature decrease is at least partly resisted due to the secondary combustion that takes place, but decarburization becomes inferior.

On the basis of the above results, the pressure $\alpha$ at which the oxidizing gas reaches the molten steel surface should preferably be about −1 to 4 in order to prevent Cr from being oxidized and to efficiently perform decarburization. The denitrification and foaming progress along with the decarburization reaction when blowing the oxidizing gas and during decarburization. This indicates that the [N] content of the stainless steel must be maintained at a high level to maintain high decarburization efficiency. This can be dealt with further by blowing $N_2$ into the molten steel when blowing the oxidizing gas and/or during decarburization.

Figure 5:
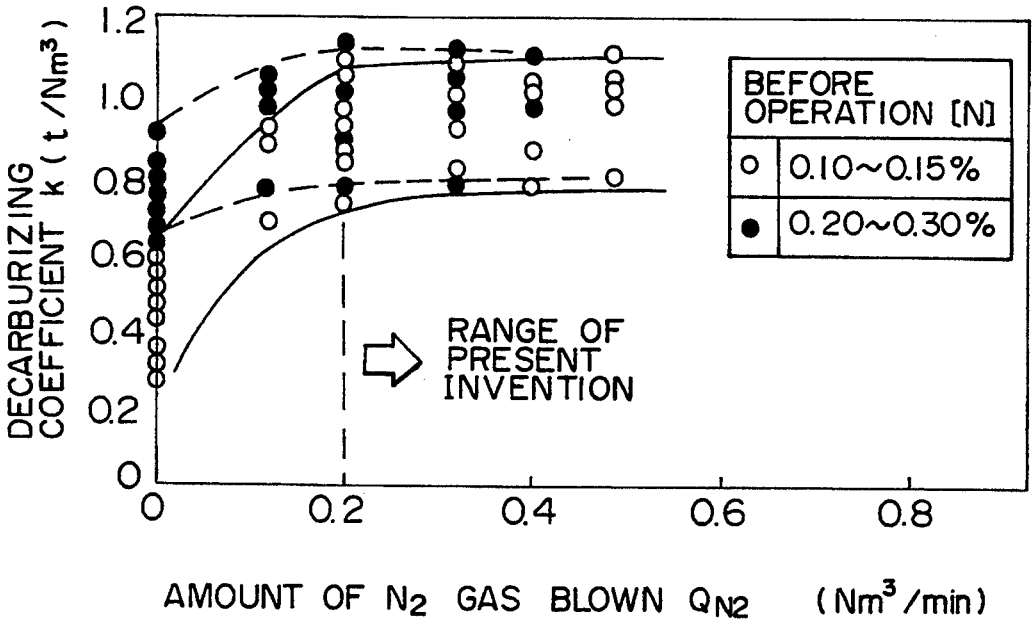
FIG. 5 is a graph illustrating the relationship between the decarburization coefficient K and the amount of $N_2$ blown.

FIG. 5 shows the relationship between the decarburization coefficient K when oxygen is blown from a top-blow lance in order to perform decarburization and the amount $Q_{NZ}$ of $N_2$ gas blown when $N_2$ gas is blown during decarburization, in a RH vacuum degassing operation for 100 tons of SUS 304 molten steel. Regarding processing conditions, the [N] content before beginning the operation was in two ranges: 0.10 to 0.15% and 0.15 to 0.20%, and the [C] content before beginning the operation was adjusted to 0.10 to 0.14%, the temperature before beginning the operation to 1,630° to 1,640° C., LH to 4.0 m, PV to 8 to 12 Torr, $S_o/S_{s\,to}$ 2.5, Q to 10 $Nm^3$/min., and the [C] content after processing to 0.03 to 0.04%. $N_2$ gas was blown by using a circulating gas of an RH degassing apparatus, the gas being mixed with Ar gas, the total rate of flow being held constant.

As can be seen from the results shown in FIG. 5, when the [N] content before beginning the operation is relatively high, that is, about 0.20 to 0.30%, the decarburization coefficient does not vary much even if the amount of $N_2$ gas blown is varied. However, when the [N] content before beginning the operation is low, that is, about 0.10 to 0.15%, the decarburization coefficient is increased when the amount of $N_2$ gas blown is 0.2 $Nm^3$/min. or more, the speed constant reaching a level nearly the same as the [N] content as it existed before the operation of 0.20 to 0.30%. This is thought to be due to the fact that when the [N] % before the operation is low, retardation of decarburization, due to denitrification at the final period of decarburization, does not occur.

As regards the RH vacuum degassing conditions for this example, it follows that $Q_{NZ}/Q_S=0.2/40=5.0\times10^{-3}$ $Nm^3/t$ since the amount $Q_S$ of the molten steel circulated in the RH degassing apparatus was 40 tons/min. Therefore, in the degassing and decarburizing method of the present invention, it is preferable that the amount of $N_2$ blown be about $5.0\times10^{-3}$ $Nm^3/t$ or more. When SUS 304 molten steel was processed with $N_2$ gas blown at $5.0\times10^{-3}$ $Nm^3/t$ or more for 60 t VOD, the same results as above were obtained.

For the purpose of blowing $N_2$ gas a circulating gas, or an immersion lance, or blowing from the pot bottom or the like are used in the RH vacuum degassing operation; blowing from the pot bottom is used in the VOD operation. As can be seen from the above, in the present invention, it is necessary to provide a high [N] % before beginning the decarburization operation. This can be achieved by refining a refining gas at a steel making furnace by using a mixture of oxygen gas and $N_2$ gas, or an inert gas containing $N_2$. When reduction is performed in a steel making furnace, it is more preferable to use $N_2$ as a reduction gas. Even if no reduction is performed, rinsing by using $N_2$ gas makes it possible to increase the [N] % in the steel. Further, when decarburization may be performed with a degassing apparatus, decarburization is performed by mixing $N_2$ gas or $N_2$ containing gas with oxygen gas and a top-blow lance. This is one of the preferred methods.

Regarding the nature of the lance used for blowing the oxidizing gas, several different arrangements of lance holes are available: a single hole and various numbers of plural holes. A comparative example was carried out on various lances. The results show that preferred decarburization can be obtained particularly in the case of plural holes.

When the number of lance holes is n, the pressure $\alpha$ is expressed as:

$$\alpha=0.808(LH)^{0.7}+0.00191(PV)+0.00388(-\Sigma S_o/\Sigma S_s)(Q/n)+2.97 \quad (4)$$

where LH is the height (m) of the lance, PV is the degree of vacuum (Torr) in the vacuum degassing tank after oxidizing gas has been supplied, $\Sigma S_s$ is the sum of areas ($mm^2$) of the nozzle throat portions of the top-blow lance, $\Sigma S_o$ is the sum of the areas ($mm^2$) of the nozzle outlet portions of the top-blow lance, Q is the rate of flow ($Nm^3$/min.) of oxygen gas, and n is the number of lance holes.

More specifically, when a lance having multiple holes is used, a softer blow is obtained at the same rate of flow of oxygen, and loss of Cr is reduced. In addition, when the decarburization rate is compared at the same bath-surface pressure value of $\alpha$, the rate is increased to such an extent that a significantly higher rate of flow of oxygen can be used.

DESCRIPTION OF THE PREFERRED EMBODIMENTS

First Embodiment

Stainless molten steels (100 t, 60 t) refined by a top-blow converter were decarbonized and refined by using an RH type circulating degassing apparatus for the 100 t and a VOD apparatus for the 60 t, each of which was provided with a water-cooling top-blow lance.

Tables 1 and 2 show a comparison between the refining performed by the present invention and that performed by the prior art. As can be seen from the refining conditions and the results of the refining processes shown in Tables 1 and 2, at least either the amount of Cr oxidized was too great or the amount of temperature decrease was too great in the case of comparative examples 8 to 10, whereas it is clear that in the embodiments 1 to 7 of the present invention, both of these amounts were small.

TABLE 1

| Steel No. | Specification | Weight of Molten Steel | Converter Refining: Refining Gas | Converter Refining: Reduction Gas | Vacuum Degassing Apparatus | LH (m) | PV (Torr) | So/Ss or ΣSo/ΣSs | Q ($Nm^3$/min) |
|---|---|---|---|---|---|---|---|---|---|
| | | | Present Invention | | | | | | |
| 1 | SUS304 | 105 | $O_2$ $N_2$ | $N_2$ | RH | 4.5 | 8 | 2.5 | 10 |
| 2 | SUS304 | 106 | $O_2$ $N_2$ | $N_2$ | RH | 4.5 | 5 | 1.5 | 15 |
| 3 | SUS304 | 58 | $O_2$ | Ar | VOD | 2.0 | 10 | 1.0 | 10 |

TABLE 1-continued

| | | | | | | | | | |
|---|---|---|---|---|---|---|---|---|---|
| 4 | SUS304 | 55 | $N_2$ $O_2$ | Ar | VOD | 2.0 | 10 | 1.2 | 10 |
| 5 | SUS304 | 110 | $N_2$ $O_2$ | Ar | RH | 5.0 | 10 | 1.5 | 10 |
| 6 | SUS430 | 107 | $N_2$ Ar $O_2$ | $N_2$ | RH | 4.5 | 12 | 1.5 | 10 |
| 7 | SUS434 | 50 | Ar $O_2$ | — | VOD | 1.0 | 8 | 2.5 | 10 |
| | | | $N_2$ Ar | Prior Art | | | | | |
| 8 | SUS304 | 98 | $O_2$ Ar | Ar | RH | 4.5 | 10 | 2.5 | 10 |
| 9 | SUS304 | 58 | $O_2$ $N_2$ | Ar | VOD | 0.5 | 50 | 10.0 | 40 |
| 10 | SUS304 | 105 | $O_2$ $N_2$ | $N_2$ | RH | 10.0 | 10 | 1.0 | 5 |

| Steel No. | No. of Lance Holes n | Oxygen Blowing Time (Oxygen Blowing Start Time After Operation Starts) (min) | Amount of Oxygen ($Nm^3/t$) | α | Amount of $N_2$ Blown into Molten Steel ($Nm^3/t$) | N(%)/Cr(%) $\times 10^{-3}$ |
|---|---|---|---|---|---|---|
| | | | Present Invention | | | |
| 1 | 1 | 11 (4–15) | 1.05 | 0.86 | 0 | 13.9 |
| 2 | 3 | 9 (4–13) | 1.27 | 0.69 | $42.5 \times 10^{-3}$ | 15.9 |
| 3 | 1 | 9 (6–15) | 1.54 | 1.72 | 0 | 5.1 |
| 4 | 4 | 8 (6–14) | 1.47 | 1.69 | $10.9 \times 10^{-3}$ | 4.8 |
| 5 | 1 | 8 (4–12) | 0.72 | 0.55 | 0 | 3.3 |
| 6 | 3 | 12 (4–16) | 1.14 | 0.70 | $5.2 \times 10^{-3}$ | 6.5 |
| 7 | 4 | 24 (6–30) | 4.86 | 2.20 | 0 | 3.0 |
| | | | Prior Art | | | |
| 8 | 1 | 13 (4–17) | 1.32 | 0.77 | 0 | 2.2 |
| 9 | 1 | 5 (6–11) | 3.47 | 4.1 | 0 | 3.7 |
| 10 | 1 | 26 (4–30) | 1.24 | −1.04 | 0 | 14.9 |

TABLE 2

| Steel No. | Specification | Vacuum Processing | Temperature (C.) | C (wt %) | Si (wt %) | Cr (wt %) | Al (wt %) | N (ppm) | O (ppm) | Amount of Cr Oxidized (kgf/t) | Amount of Temperature Decrease ΔT (C.) |
|---|---|---|---|---|---|---|---|---|---|---|---|
| | | | | Present Invention | | | | | | | |
| 1 | SUS304 | Before Processing (A) | 1635 | 0.12 | 0.15 | 18.44 | 0.001 | 2568 | 65 | 0.08 | 13 |
| | | After Oxygen Blowing (B) | 1622 | 0.05 | 0.14 | 18.43 | 0.001 | 342 | 45 | | |
| | | After Processing (C) | 1603 | 0.03 | 0.50 | 18.42 | 0.001 | 285 | 32 | | |
| 2 | SUS304 | (A) | 1638 | 0.14 | 0.18 | 18.20 | 0.001 | 2896 | 72 | 0.04 | 3 |
| | | (B) | 1635 | 0.03 | 0.17 | 18.20 | 0.001 | 331 | 40 | | |
| | | (C) | 1600 | 0.03 | 0.51 | 18.20 | 0.001 | 296 | 28 | | |
| 3 | SUS304 | (A) | 1645 | 0.10 | 0.19 | 18.18 | 0.001 | 926 | 58 | 0.26 | 14 |
| | | (B) | 1631 | 0.05 | 0.18 | 18.15 | 0.001 | 285 | 55 | | |
| | | (C) | 1595 | 0.04 | 0.55 | 18.14 | 0.001 | 261 | 43 | | |
| 4 | SUS304 | (A) | 1648 | 0.14 | 0.13 | 18.20 | 0.001 | 868 | 62 | 0.15 | 9 |
| | | (B) | 1639 | 0.04 | 0.12 | 18.18 | 0.001 | 295 | 50 | | |
| | | (C) | 1600 | 0.05 | 0.55 | 18.18 | 0.001 | 276 | 39 | | |
| 5 | SUS304 | (A) | 1638 | 0.08 | 0.20 | 18.32 | 0.001 | 602 | 62 | 0.20 | 15 |
| | | (B) | 1623 | 0.06 | 0.18 | 18.30 | 0.001 | 235 | 62 | | |
| | | (C) | 1598 | 0.05 | 0.50 | 18.29 | 0.001 | 200 | 48 | | |
| 6 | SUS430 | (A) | 1662 | 0.14 | Tr | 16.25 | 0.001 | 1056 | 562 | 0.19 | 16 |
| | | (B) | 1646 | 0.04 | Tr | 16.23 | 0.001 | 236 | 82 | | |
| | | (C) | 1615 | 0.03 | 0.25 | 16.23 | 0.015 | 189 | 22 | | |
| 7 | SUS434 | (A) | 1696 | 0.14 | Tr | 17.25 | 0.001 | 520 | 682 | 0.25 | 18 |

TABLE 2-continued

| Steel No. | Specification | Vacuum Processing | Temperature (C.) | C (wt %) | Si (wt %) | Cr (wt %) | Al (wt %) | N (ppm) | O (ppm) | Amount of Cr Oxidized (kgf/t) | Amount of Temperature Decrease ΔT (C.) |
|---|---|---|---|---|---|---|---|---|---|---|---|
| | | (B) | 1678 | 0.02 | Tr | 17.22 | 0.001 | 156 | 78 | | |
| | | (C) | 1620 | 0.006 | 0.30 | 17.22 | 0.30 | 86 | 18 | | |
| | | | | | Prior Art | | | | | | |
| 8 | SUS304 | (A) | 1638 | 0.09 | 0.21 | 18.88 | 0.001 | 422 | 60 | 0.88 | 25 |
| | | (B) | 1613 | 0.07 | 0.18 | 18.79 | 0.001 | 382 | 82 | | |
| | | (C) | 1585 | 0.06 | 0.56 | 18.77 | 0.001 | 326 | 62 | | |
| 9 | SUS304 | (A) | 1650 | 0.12 | 0.25 | 18.90 | 0.001 | 692 | 65 | 1.48 | 5 |
| | | (B) | 1645 | 0.06 | 0.12 | 18.75 | 0.001 | 420 | 98 | | |
| | | (C) | 1602 | 0.03 | 0.58 | 18.70 | 0.001 | 382 | 79 | | |
| 10 | SUS304 | (A) | 1635 | 0.12 | 0.19 | 18.20 | 0.001 | 2716 | 62 | 0.19 | 24 |
| | | (B) | 1611 | 0.11 | 0.19 | 18.19 | 0.001 | 656 | 60 | | |
| | | (C) | 1590 | 0.11 | 0.19 | 18.19 | 0.001 | 526 | 55 | | |

Next, a further aspect of the present invention will be explained with reference to specific examples we have carried out.

Figure 6:
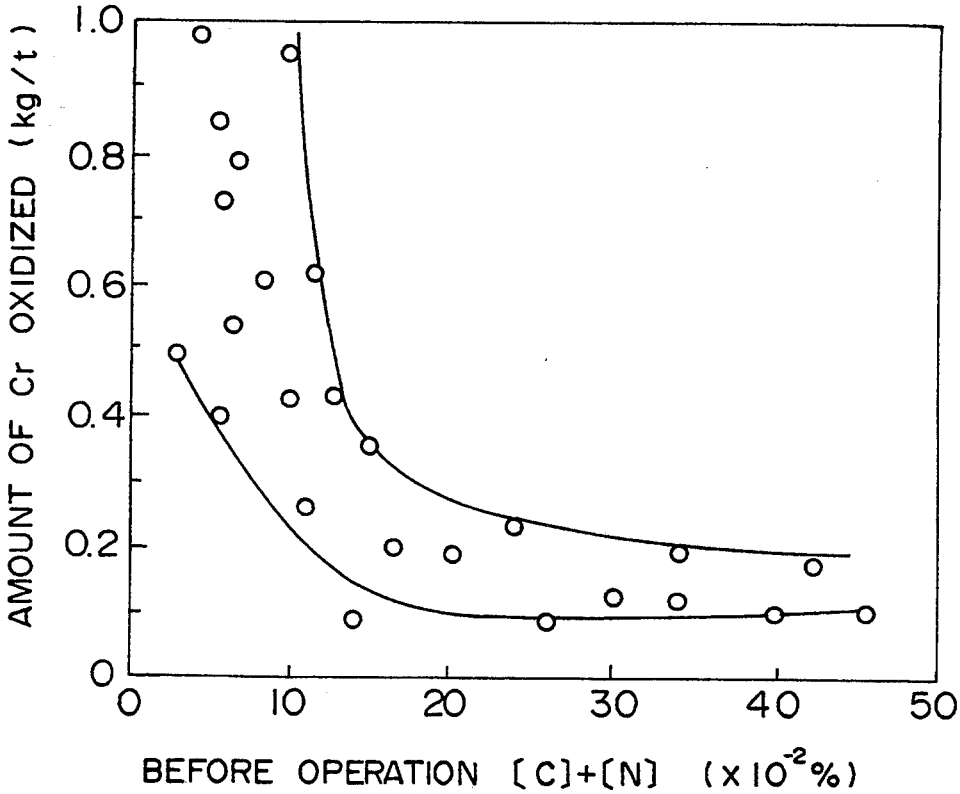
FIG. 6 is a graph illustrating the relationship between the [C] (%)+IN] (%) before beginning the operation and the amount of Cr oxidized.

FIG. 6 illustrates the relationship between [C] (%)+[N] (%) before beginning the decarburization operation and the loss of Cr during blowing of oxygen, when a decarburization operation was performed by blowing oxygen onto 100 tons of molten stainless SUS 304 steel from a top-blow lance. The Al content of this molten steel was 0.002% or less. The processing conditions at this time were: [C] before beginning the operation 0.09 to 0.14%, [C] after finishing the operation 0.03 to 0.04%, the temperature before beginning the operation 1,630° to 1,640°, the height of the lance tip from the molten steel surface 3.5 m, So/Ss 4.0, the rate of flow of oxygen from the lance 10 $Nm^3$/min., the total oxygen source unit 0.6 to 1.2 $Nm^3$/t, and the degree of vacuum reached when the blowing of oxygen has been terminated 8 to 12 Torr.

It can be seen from FIG. 6 that the amount of Cr oxidized increased when the total content of [C]+[N] in the molten steel was 0.14% or less. The amount of Cr oxidized was a value (kgf/t) in which the Cr content after blowing of oxygen was terminated was subtracted from the Cr content as it existed before beginning the operation. On the basis of the above results, the total amount of [C] (%)+[N] (%) before beginning the vacuum degassing operation was controlled to a value of 0.14% or more.

In addition to [N], [H] may be considered as a factor for causing foaming of molten steel. However, [N] was proved to be most appropriate as a foaming component for reasons heretofore discussed.

Figure 7:
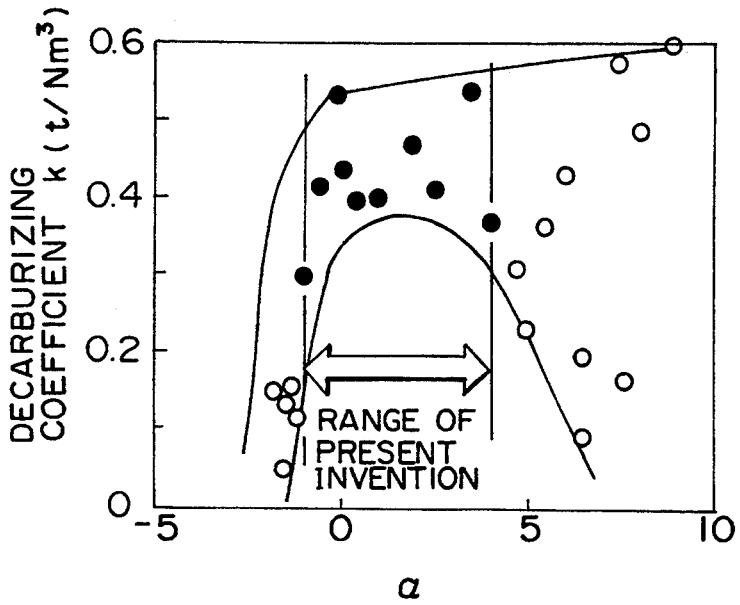
FIG. 7 is a graph illustrating the relationship between the decarburization coefficient K and the pressure $\alpha$ at which the oxidizing gas contacts the molten-steel surface.
Figure 8:
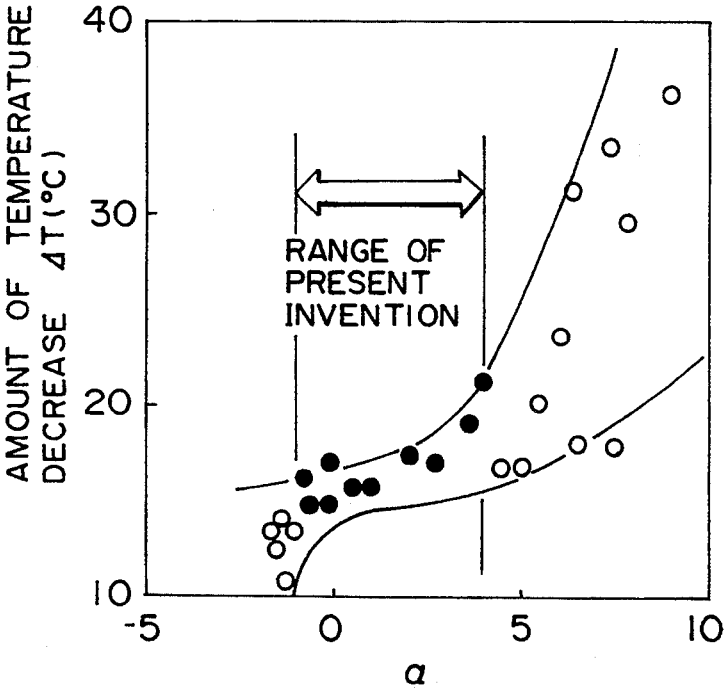
FIG. 8 is a graph illustrating the relationship between the temperature decrease and the pressure $\alpha$ at which oxidizing gas contacts the molten-steel surface.

Next, regarding the blowing of oxygen in the vacuum degassing tank, decarburization behavior and decrease of temperature were investigated, using the equation (1). The results of the investigation are shown in FIGS. 7 and 8.

Steel of the SUS 304 type was used, the [C] content before beginning the RH vacuum degassing operation was 0.11 to 0.14%, the [C] content after the RH vacuum degassing operation was finished was 0.03 to 0.04%, and the [N] content before beginning the RH vacuum degassing operation was 0.15 to 0.20%. The conditions for the operation were LH: 1 to 12 m, PV: 0.3 to 100 Torr, So/Ss: 1 to 46.8, and Q: 5 to 50 $Nm^3$/min., and the temperature before beginning the decarburization operation was 1,630° to 1,640° C.

The decarburization behavior was controlled to accord with the decarburization coefficient defined by equation (2):

$$[C]_s/[C]=kQ(O_2) \quad (2)$$

where $[C]_s$ is the [C] % before beginning the RH operation, [C] is the [C] % after the blowing of oxidizing gas was terminated in the RH operation, k is the decarburization coefficient (t/$Nm^3$), and $Q(O_2)$ is the amount of oxygen ($Nm^3$/t). Further, the amount of temperature decrease was defined by the following equation (3):

$$\Delta T=T_s-T \quad (3)$$

where $T_s$ was the temperature (°C.) of the molten steel when the RH operation was started, and T was the temperature (°C.) of the molten steel after the blowing of oxygen was terminated.

It can be seen from FIGS. 7 and 8 that the preferred range of the value $\alpha$ which satisfied both excellent decarburization rate and excellent resistance to temperature decrease, is from about −1 to 4. More specifically, if $\alpha$ exceeds about 4, both the decarburization coefficient and the temperature decrease vary greatly, causing the decarburization rate to decrease. This is due to the fact that Cr is oxidized with the decarburization and that Cr oxidation impedes decarburization. If, in contrast, $\alpha$ is about −1 or less, the temperature decrease is resisted due to secondary combustion but decarburization becomes inferior.

Further Embodiment

Oxygen at the rate of flow of 15 $Nm^3$/min. was supplied to 100 tons of SUS 304 molten stainless steel which was reduced and tapped by a top-blow converter for five minutes after a lapse of four minutes from when the processing was started by using an RH type circulating degassing apparatus, provided with a top-blow lance under the following conditions: height LH of the lance was 5.0 m, the attained vacuum PV was 10 Torr, and So/Ss was 4.0. $\alpha$ at this time was 0.72. The compositions of the molten steel thus obtained are shown in Table 3.

TABLE 3

| | (wt %) | | | | | | | | | | |
|---|---|---|---|---|---|---|---|---|---|---|---|
| | C | Si | Mn | P | S | Cr | Ni | Al | O (ppm) | N (ppm) | Temperature (°C.) |
| Before RH Processing | 0.13 | 0.18 | 1.10 | 0.30 | 0.003 | 18.32 | 8.51 | 0.001 | 52 | 2346 | 1637 |
| After Oxygen has been blown | 0.04 | 0.16 | 1.09 | 0.03 | 0.003 | 18.30 | 8.52 | 0.001 | 61 | 403 | 1625 |

TABLE 3-continued

| | (wt %) | | | | | | | | | | |
|---|---|---|---|---|---|---|---|---|---|---|---|
| | C | Si | Mn | P | S | Cr | Ni | Al | O (ppm) | N (ppm) | Temperature (°C.) |
| After RH has been terminated | 0.04 | 0.35 | 1.15 | 0.03 | 0.003 | 18.31 | 8.51 | 0.001 | 34 | 385 | 1602 |

As a comparative example, an operation supplying oxygen at the rate of flow of 15 $Nm^3$/min. was also performed for three minutes after a lapse of five minutes from when the processing started under the following conditions: the height LH of the lance was 2.5 m, the attained vacuum PV was 10 Torr, and the lance diameter So/Ss was 9.0. The value of $\alpha$ at this time was 1.98. The compositions of the molten steel thus obtained are shown in Table 4.

TABLE 4

| | (wt %) | | | | | | | | | | |
|---|---|---|---|---|---|---|---|---|---|---|---|
| | C | Si | Mn | P | S | Cr | Ni | Al | O (ppm) | N (ppm) | Temperature (°C.) |
| Before RH Processing | 0.06 | 0.22 | 1.11 | 0.03 | 0.002 | 18.28 | 8.53 | 0.001 | 49 | 286 | 1641 |
| After Oxygen has been blown | 0.03 | 0.17 | 1.08 | 0.03 | 0.003 | 18.17 | 8.52 | 0.001 | 92 | 268 | 1618 |
| After RH has been terminated | 0.03 | 0.35 | 1.15 | 0.03 | 0.003 | 18.16 | 8.52 | 0.001 | 72 | 265 | 1600 |

Table 5 shows a comparison between the amounts of Cr oxidized, the amounts of temperature decrease, the amounts of oxygen remaining after the RH processing of the present invention and of the prior art. It can be seen from Table 5 that in the present invention, low-oxygen stainless molten steel can be obtained when the amount of Cr oxidized is small and the temperature decrease is small.

TABLE 5

| Amount of Cr Oxidized (kgf/t) | Amount of Temperature Decrease (Δ T) | Oxygen After RH Processing (ppm) |
|---|---|---|
| | Present Invention | |
| 0.19 | 12° C. | 34 |
| | Prior Art | |
| 1.08 | 23° C. | 72 |

Third Embodiment

Oxygen at the rate of flow of 10 $Nm^3$/min. was supplied to 60 tons of SUS 304 stainless molten steel which was weakly reduced and tapped by a top-blow converter for eight minutes after a lapse of five minutes from when the processing started by using a VOD apparatus provided with a top-blow lance under the following conditions: the height LH of the lance was 3.5 m; the vacuum PV was 5.0 Torr; and the So/Ss was 1.0. The value of $\alpha$ at this time was 1.08. The compositions of the molten steel thus obtained are shown in Table 6.

TABLE 6

| | (wt %) | | | | | | | | | |
|---|---|---|---|---|---|---|---|---|---|---|
| | C | Si | Mn | P | S | Cr | Al | O (ppm) | N (ppm) | Temperature (°C.) |
| Before VOD processing | 0.14 | Tr | 0.62 | 0.03 | 0.004 | 16.54 | — | — | 898 | 1692 |
| After Oxygen has been blown | 0.06 | Tr | 0.60 | 0.03 | 0.004 | 16.51 | — | 76 | 368 | 1677 |
| After RH has been terminated | 0.05 | 0.15 | 0.65 | 0.03 | 0.004 | 16.50 | 0.015 | 28 | 352 | 1651 |

As a comparative example, oxygen was supplied at the rate of flow of 10 $Nm^3$/min. for eight minutes after a lapse of five minutes from when the processing started under the following conditions: the height LH of the lance was 1.5 m; the degree of the reached vacuum PV was 5.0 Torr; and the So/Ss was 4.0. The value of $\alpha$ at this time was 2.06. The compositions of the molten steel thus obtained are shown in Table 7.

TABLE 7

| | (wt %) | | | | | | | | | |
|---|---|---|---|---|---|---|---|---|---|---|
| | C | Si | Mn | P | S | Cr | Al | O (ppm) | N (ppm) | Temperature (°C.) |
| Before VOD processing | 0.06 | Tr | 0.59 | 0.03 | 0.005 | 16.42 | — | — | 263 | 1688 |
| After Oxygen has been blown | 0.04 | Tr | 0.56 | 0.03 | 0.005 | 16.30 | — | 112 | 221 | 1662 |
| After RH has been terminated | 0.04 | 0.16 | 0.60 | 0.03 | 0.006 | 16.31 | 0.018 | 61 | 28 | 1650 |

Table 8 shows a comparison between the amounts of Cr oxidized, the amounts of temperature decrease, the amounts of oxygen remaining after RH processing of the present invention and of the prior art. It can be seen from Table 8 that in the present invention, low-oxygen stainless steel can be obtained in which the amount of Cr oxidized is small and the temperature decrease is small.

TABLE 8

| Amount of Cr Oxidized (kgf/t) | Amount of Temperature Decrease (Δ T) | Oxygen after RH Processing (ppm) |
|---|---|---|
| | Present Invention | |
| 0.31 | 15° C. | 28 |
| | Prior Art | |
| 1.22 | 26° C. | 61 |

Fourth Embodiment

Oxygen at the rate of flow of 15 $Nm^3$/min. was supplied to 100 tons of extremely-low-carbon stainless molten steel which was reduced and then tapped by a top-blow converter for 30 minutes after a lapse of four minutes from when the processing started by using an RH type circulating degassing apparatus, provided with a top-blow lance under the following conditions: the height LH of the lance was 3.0 m; the degree of the reached vacuum PV was 5.0 Torr; and So/Ss was 4.0. Thereafter, rimmed decarburization was performed for 15 minutes. The value of $\alpha$ at this time was 1.47. The compositions of the molten steel thus obtained are shown in Table 9.

TABLE 9

| | (wt %) | | | | | | | | | | | | |
|---|---|---|---|---|---|---|---|---|---|---|---|---|---|
| | C | Si | Mn | P | S | Cr | Ni | Al | Ti | Mo | O (ppm) | N (ppm) | Temperature (°C.) |
| Before RH Processing | 0.14 | 0.02 | 0.20 | 0.03 | 0.003 | 18.01 | 0.05 | — | — | 1.23 | — | 503 | 1660 |
| After Oxygen has been blown | 0.006 | 0.01 | 0.18 | 0.03 | 0.004 | 17.88 | 0.05 | — | — | 1.23 | — | 98 | 1645 |
| After RH has been terminated | 0.006 | 0.07 | 0.17 | 0.03 | 0.004 | 17.86 | 0.05 | 0.038 | 0.335 | 1.22 | 26 | 90 | 1595 |

As a comparative example, an operation supplying oxygen at a rate of flow of 30 $Nm^3$/min. was also performed for 20 minutes after a lapse of four minutes from when the processing started under the following conditions: the height LH of the lance was 1.0 m; the degree of the reached vacuum PV was 30 Torr; and So/Ss was 20.3. Thereafter, rimmed decarburization was performed for 15 minutes as in the above-described embodiment. The value of $\alpha$ at this time was 4.58. The compositions of the molten steel thus obtained are shown in Table 10.

TABLE 10

| | (wt %) | | | | | | | | | | | | |
|---|---|---|---|---|---|---|---|---|---|---|---|---|---|
| | C | Si | Mn | P | S | Cr | Ni | Al | Ti | Mo | O (ppm) | N (ppm) | Temperature (°C.) |
| Before RH Processing | 0.12 | 0.03 | 0.19 | 0.03 | 0.003 | 18.11 | 0.04 | — | — | 1.31 | — | 182 | 1655 |
| After Oxygen has been blown | 0.011 | 0.02 | 0.18 | 0.03 | 0.003 | 17.43 | 0.05 | — | — | 1.30 | — | 88 | 1643 |
| After RH has been terminated | 0.010 | 0.01 | 0.17 | 0.03 | 0.003 | 17.41 | 0.03 | 0.038 | 0.303 | 1.30 | 62 | 89 | 1595 |

Table 11 shows a comparison between the amounts of Cr oxidized, the amounts of temperature decrease, the amounts of oxygen remaining after RH processing of the present invention and of the prior art. It can be seen from Table 11 that in the present invention, a high Ti yield could be obtained because the amount of Cr oxidized was small. The temperature decrease is small also in the comparative example, which is due to the fact that the amount of heat generation of Cr oxidation was small.

TABLE 11

| Amount of Cr Oxidized (kgf/t) | Amount of Temperature Decrease (Δ T) | Amount of Oxygen after RH Processing (ppm) | Yield of Ti (%) |
|---|---|---|---|
| | Present Invention | | |
| 1.31 | 15° C. | 26 | 80 |
| | Prior Art | | |
| 6.84 | 12° C. | 62 | 72 |

According to the present invention, as described above, decarburization can be promoted while suppressing Cr oxidation and temperature decrease. Therefore, since blowing out the [C] (%) of the converter can be increased, it is possible to reduce the amount of FeSi used for reduction purposes. In addition, since the amount of Cr oxidized can be reduced considerably, it is possible to realize a low oxygen content of about 50 ppm or less without using Al as a deoxidizer. Also, there are further advantages that raw metal can be prevented from depositing on the inside of the vacuum tank, or on the lid of a VOD apparatus, or on a ladle or the like. This is because the metal is subjected to foaming and heat generation due to secondary combustion during denitrification and decarburization.

Many different embodiments may be adopted without departing from the spirit and scope of the invention. It should be understood that this invention is not limited to the specific embodiments described in the specification. To the contrary, the present invention is intended to cover various modifications and equivalent arrangements that are included with the spirit and scope of the claims. The following claims should be accorded the broadest interpretation to encompass all such modifications and equivalent structures and functions.

What is claimed is:

1. A method of vacuum degassing and decarburizing molten stainless steel, which molten steel is a product of a steelmaking furnace, comprising the steps of:

foaming said molten steel in a vacuum degassing tank by denitrifying said steel;

vacuum degassing said foaming steel;

blowing oxidizing gas onto the surface of said steel in said vacuum degassing tank, thereby conducting a decarburization reaction wherein carbon is reacted with oxygen to from carbon monoxide, and causing combustion of said carbon monoxide to resist temperature decrease of the molten steel as said decarburization reaction proceeds.

2. A method according to claim 1, wherein said steel has an [N] % as it exists before degassing, which percentage is increased by incorporating $N_2$ into said steel in said steelmaking furnace.

3. A method according to either one of claims 1 and 2, wherein prior to said foaming step an $N_2$ gas or an inert gas containing $N_2$ is introduced into said steelmaking furnace to perform reduction using alloy iron after oxidation refining in said steel making furnace, whereby the [N] % in the molten steel in said steelmaking furnace is increased.

4. A method according to any one of claims 1 or 2 wherein said oxidizing gas is a mixture of $O_2$ and $N_2$, or a mixture of inert gases containing $O_2$ and $N_2$, and is blown onto the bath surface from a top-blow lance disposed in said vacuum degassing tank.

5. A method according to any one of claims 1 or 2, wherein $N_2$ gas or $N_2$ containing gas of more than $5.0\times10^{-3}$ $Nm^3$/t is blown from a top-blow lance disposed in said vacuum degassing tank when said oxidizing gas is blown onto the surface of said molten steel.

6. In a method of vacuum degassing and decarburizing molten stainless steel, which stainless molten steel is a product of a steel making furnace, the steps comprising:

adjusting the ratio [N(%)]/[Cr(%)] in the molten steel before commencement of degassing to about $3.0\times10^{-3}$ or above;

blowing an oxidizing gas, through a lance having a nozzle throat and a nozzle outlet, onto the surface of said molten steel while applying vacuum to said steel;

controlling the pressure of said blowing at the molten steel surface to an $\alpha$ value of about $-1$ to 4, being defined as follows:

$$\alpha=-0.808(LH)^{0.7}+0.00191(PV)+0.00388(S_o/S_s)Q+2.97,$$

wherein LH is the height (m) from the stationary bath surface of the molten steel to point of blowing; PV is the degree of vacuum (Torr) applied to said steel after said oxidizing gas has been blown; $S_s$ is the area ($mm^2$) of a nozzle throat of said lance; $S_o$ is the area ($mm^2$) of a nozzle outlet portion of said lance; and Q is the rate of flow ($Nm^3$/min.) of said oxidizing gas.

7. A method of degassing and vacuum decarburizing according to claim 6, wherein the [N] % of the steel before the beginning of the decarburizing operation is increased in a steelmaking furnace by introducing a gas composed of $O_2$, $N_2$, or $O_2$ and $N_2$ as an oxidizing refining gas, whereby the [N] %/[Cr] % in the molten steel is adjusted.

8. A method according to either one of claims 6 or 7, wherein an $N_2$ gas or an inert gas containing $N_2$ is used to perform reduction by using alloy iron after oxidation refining in a steel making furnace when the [N] %/[Cr] % in the molten steel is adjusted.

9. A method according to either one of claims 6 or 7, wherein a mixture gas of $O_2$ and $N_2$, or containing $O_2$ and $N_2$, is used as an oxidizing gas and is blown onto the bath surface from said lance in a vacuum degassing tank.

10. A method according to either one of claims 6 or 7, wherein $N_2$ gas or $N_2$ containing gas of more than $5.0\times10^{-3}$ $Nm^3$/t is blown from said lance in said vacuum degassing tank when concurrently said oxidizing gas is blown onto the surface of said molten steel and/or when the molten steel is subjected to decarburization.

11. A method of vacuum degassing and decarburizing according to either one of claims 6 or 7, wherein said lance is a top-blow lance having a plurality of lance holes and is disposed in said vacuum degassing tank, and wherein $\alpha$ is about $-1$ to 4 in the equation:

$$\alpha=-0.808(LH)^{0.7}+0.00191(PV)+0.00388(\Sigma S_o\Sigma S_s)(Q/n)+2.97,$$

where LH is the height (m) of the lance; PV is the degree of vacuum (Tort) in the vacuum degassing tank after the oxidizing gas has been introduced; $\Sigma S_s$ is the sum of the areas ($mm^2$) of the nozzle throat portions of the top-blow lance; $\Sigma S_o$ is the sum of the areas ($mm^2$) of the nozzle outlet portions of the top-blow lance; Q is the rate of flow ($Nm^3$/min.) of oxygen gas, and n is the number of lance holes.

12. A method according to claim 1, said molten steel being produced in a steelmaking furnace, comprising the step in said steelmaking furnace of adjusting the sum of [C] and [N] in the molten steel to about 0.14 wt. % before oxidation; then transferring the adjusted steel to a vacuum degassing tank and blowing oxidizing gas onto the surface of said molten steel in said vacuum degassing tank through a top-blow lance so that the value $\alpha$ is from about $-1$ to 4, $\alpha$ being defined by the equation:

$$\alpha=-0.808\ (LH)^{0.7}+0.00191\ (PV)+0.00388\ (S_o/S_s)Q+2.97,$$

where LH is the height (m) from the surface of the molten steel to the tip of the top-blow lance in the vacuum degassing tank; PV is the vacuum (Torr) in the vacuum degassing tank after oxidizing gas has been introduced; $S_s$ is the area ($mm^2$) of a nozzle throat of the top-blow lance; $S_o$ is the area ($mm^2$) of a nozzle outlet portion of the top-blow lance; and Q is the rate of flow ($Nm^3$/min.) of oxygen gas.

13. A method according to claim 12, wherein the [N] % in said steel before degassing is increased by introducing $O_2$, $N_2$, or $O_2$ and $N_2$ as an oxidizing refining gas in said steelmaking furnace when the [N] %/[Cr] % in said molten steel is adjusted.

14. A method according to either one of claims 12 or 13, wherein $N_2$ gas or an inert gas containing $N_2$ is applied to perform reduction in said steelmaking furnace by using alloy iron after oxidation refining in said steelmaking furnace, whereby the [N] %/[Cr] % in the molten steel is adjusted.

15. A method according to either one of claims 12 or 13, wherein a mixture of $O_2$ and $N_2$, or a mixture of inert gases containing $O_2$ and $N_2$, is introduced as an oxidizing gas and is blown onto the bath surface from said top-blow lance disposed in the vacuum degassing tank.

16. A method according to either one of claims 12 or 13, wherein $N_2$ gas or $N_2$ containing gas of more than $5.0\times10^{-3}$ $Nm^3$/t is blown from said top-blow lance disposed in said vacuum degassing tank when an oxidizing gas is blown onto the surface of said molten steel and/or when said molten steel is decarbonized.

17. A method according to either one of claims 12 or 13, wherein a plurality of lance holes is present in said top-blow lance, and wherein the conditions for blowing said oxidizing gas are controlled to limit $\alpha$ to a value from about $-1$ to 4 in the equation:

$$\alpha=-0.808(LH)+0.00191(PV)+0.00388(\Sigma S_o/\Sigma S_s)(Q/n)+2.97,$$

where LH is the height (m) of said lance; PV is the degree of vacuum (Torr) in said vacuum degassing tank after oxidizing gas has been supplied; $\Sigma S_s$ is the sum of areas ($mm^2$) of the nozzle throat portions of the top-blow lance; $\Sigma S_o$ is the sum of the areas ($mm^2$) of nozzle outlet portions of the top-blow lance, Q is the rate of flow ($Nm^3$/min.) of oxygen gas; and n is the number of lance holes in said lance.

18. The method defined in claim 2 wherein the [N] % is increased to about 0.20–0.30%.

19. The method defined in claim 2 wherein the [N] % divided by the [Cr] $\%\times10^{-3}$ is about 3 or more.

* * * * *

UNITED STATES PATENT AND TRADEMARK OFFICE

CERTIFICATE OF CORRECTION

PATENT NO. : 5,356,456
DATED : October 18, 1994
INVENTOR(S) : Hiroshi Nishikawa et al It is certified that error appears in the above-indentified patent and that said Letters Patent is hereby corrected as shown below:

In column 2, line 30, please change "(%)+lN]" to --(%)+[N]--.

In column 3, line 6, please change "0.00388-" to --0.00388".

In column 4, line 19, please change "P(Tort)" to --P(Torr)--; and line 30, please change "(Tort)" to --(Torr)--.

In column 5, line 10, please change "IN]" to --[N]--; and line 32, please change "IN]" to --[N]--.

In column 6, line 29, please change "Tort" to --Torr--; and line 45, please change "$\Delta T=T_sT$" to --$\Delta T=T_s-T$--.

In column 7, line 20, please change "$S_o/S_s$ to 2.5," to --$S_o/S_s$ to 2.5,--.

In column 8, line 21, please change "0.00388(-" to --0.00388(--.

In columns 13 & 14, in Table 7, under heading "N(ppm)", 3 lines down, please change "28" to --228--.

In column 16, line 54, please change "and" to --or--.

UNITED STATES PATENT AND TRADEMARK OFFICE

CERTIFICATE OF CORRECTION

PATENT NO. : 5,356,456

DATED : October 18, 1994

INVENTOR(S) : Hiroshi Nishikawa, et al

It is certified that error appears in the above-indentified patent and that said Letters Patent is hereby corrected as shown below:

In column 17, line 15, please change "4, being" to --4, α being--; and line 57, please change "($\Sigma S_o \Sigma$" to --($\Sigma S_o / \Sigma$--.

Signed and Sealed this

Sixth Day of December, 1994

Bruce Lehman

*Attest:*

BRUCE LEHMAN

*Attesting Officer*

*Commissioner of Patents and Trademarks*